US009468274B2

(12) United States Patent
You

(10) Patent No.: US 9,468,274 B2
(45) **Date of Patent: *Oct. 18, 2016**

(54) UMBRELLA HAVING TELESCOPIC FRP SHANK

(71) Applicant: Ching-Chuan You, Taipei (TW)

(72) Inventor: Ching-Chuan You, Taipei (TW)

( * ) Notice: Subject to any disclaimer, the term of this patent is extended or adjusted under 35 U.S.C. 154(b) by 215 days.

This patent is subject to a terminal disclaimer.

(21) Appl. No.: 14/178,296

(22) Filed: Feb. 12, 2014

(65) Prior Publication Data

US 2015/0208772 A1 Jul. 30, 2015

(30) Foreign Application Priority Data

Jan. 27, 2014 (CN) ..... 2014 2 0052045 U

(51) Int. Cl.
*A45B 25/16* (2006.01)
*A45B 25/14* (2006.01)
*A45B 19/04* (2006.01)

(52) U.S. Cl.
CPC ..... *A45B 25/16* (2013.01); *A45B 19/04* (2013.01); *A45B 25/143* (2013.01)

(58) Field of Classification Search
CPC .... A45B 19/04; A45B 25/006; A45B 25/14; A45B 25/143; A45B 25/16
See application file for complete search history.

(56) References Cited

U.S. PATENT DOCUMENTS 4,548,222 A * 10/1985 Day ..... A45B 25/143 135/24
5,058,613 A * 10/1991 Su ..... A45B 19/00 135/20.3
5,144,969 A * 9/1992 Chou ..... A45B 25/16 135/22
6,626,197 B2 * 9/2003 Lin ..... A45B 25/143 135/22
6,866,053 B2 3/2005 You
7,261,112 B2 * 8/2007 Liu ..... A45B 19/04 135/25.1
7,735,498 B2 * 6/2010 You ..... A45B 25/143 135/24
7,789,096 B1 * 9/2010 Liu ..... A45B 19/04 135/20.3
D685,568 S * 7/2013 You ..... D3/10
9,131,755 B1 * 9/2015 You ..... A45B 19/04

FOREIGN PATENT DOCUMENTS

CA 2076821 A1 * 2/1994 ..... A45B 19/00
EP 0518814 A2 * 12/1992 ..... A45B 25/143

* cited by examiner

*Primary Examiner* — David R Dunn
*Assistant Examiner* — Danielle Jackson

(57) ABSTRACT

An umbrella shank is provided with an FRP inner tube (10); an FRP outer tube (20) for receipt of the inner tube (10); a spring biased moving mechanism (30) including an upper member (31) having a longitudinal groove (311), and a lower member (32) having a longitudinal groove (321) aligned with the groove (311) wherein the lower member (32) is inserted into the inner tube (10), the upper member (31) is on the top of the inner tube (10), and the upper member (31) is in the outer tube (20); a fixing mechanism (40) in an upper portion of the outer tube (20); and a linking mechanism (60) in the outer tube (20) and including a rod (62) having a top secured to the fixing mechanism (40) and a bottom secured to a bottom of the lower member (32), and partially disposed in the grooves (311, 321).

2 Claims, 12 Drawing Sheets

UMBRELLA HAVING TELESCOPIC FRP SHANK

BACKGROUND OF THE INVENTION

1. Field of the Invention

The invention relates to umbrella frame and more particularly to a telescopic shank of a collapsible umbrella, the shank being made of fibre-reinforced plastic (FRP) having advantages including light weight.

2. Description of Related Art

Umbrellas are personal articles. An umbrella can be collapsible or non-folding. An umbrella comprises a shank, a rib assembly, and a canopy secured onto the rib assembly. A collapsible umbrella has a folding rib assembly and a telescopic shank. A non-folding umbrella has a shank of fixed length. Shank of an umbrella can be made of metal or fibre-reinforced plastic (FRP). Shank of a collapsible umbrella comprises an outer tube, an inner tube, and a moving mechanism mounted in the inner tube. Typically, the inner tubes of small umbrellas are made of metal. Large umbrellas (e.g., golf umbrellas) have shanks of larger diameter, and a large rib and stretcher assembly. Thus, they are heavy. It is labor consuming for a user carrying a large umbrella for long distance walk. Therefore, both the inner tube and the outer tube of shank of a large umbrella (e.g., gold umbrella) are made of FRP.

U.S. Pat. No. 6,866,053 entitled "Beach Umbrella Having Telescopic Shank" discloses a telescopic shank made of FRP wherein both the inner tube and the outer tube have eccentric section so that they can be fastened together. However, its manufacturing is difficult because eccentric tubes cannot be easily molded due to different wall thicknesses. Further, fibers are not uniform in length. Furthermore, polymers of FRP are not uniformly mixed in the manufacturing process. Thus, precision of both the inner tube and the outer tube is poor with looser tolerances. As a result, both the inner tube and the outer tube tend to malfunction after a time of use.

Further, metal shank can be machined but FRP shank cannot be machined. Thus, positioning of the inner tube and the outer tube and positioning of the inner tube and the moving mechanism are impossible for FRP shank. Thus, no disclosure of telescopic FRP shank of an umbrella is available. To the contrary, improvements with respect to weigh reduction of a large umbrella (e.g., golf umbrella) are made continuously. As a result, length reduction of an umbrella shank made of FRP is not possible as the present inventor is aware.

For reducing weight of umbrella shank, aluminum alloy or other light metal materials can be used as raw material for manufacturing umbrellas. However, its manufacturing cost is several times of that of FRP frame. That is, its market survivability is low due to competitiveness. Thus, how to devise a light umbrella having a telescopic FRP shank is always desirable among manufacturers in the art. The invention discussed below aims at providing a collapsible umbrella having a telescopic shank made of FRP with all drawbacks associated with conventional large umbrellas being eliminated.

SUMMARY OF THE INVENTION

It is therefore one object of the invention to provide a telescopic FRP shank of an umbrella, especially a large umbrella such as a golf umbrella, with improvements including generous clearances between moving components without sacrificing reliable operation, weight reduction, durability, and competitiveness.

For achieving above and other objects, in a first aspect of the invention provides an umbrella shank comprising an inner tube formed of fibre-reinforced plastic (FRP) and including an interior; an outer tube formed of FRP and including an interior having an inner diameter greater than an outer diameter of the inner tube so that the inner tube is configured to insert into the outer tube; a moving mechanism including an upper member and a lower member wherein the upper member has a polygonal section, the upper member is complementary to the interior of the outer tube in shape, the upper member includes a longitudinal groove on an outer surface, the lower member includes a longitudinal groove on an outer surface, the longitudinal grooves, are aligned, the lower member is inserted into the interior of the inner tube, a bottom of the longitudinal groove of the upper member is disposed on a top of the inner tube, the upper member is disposed on the top of the inner tube, and the upper member is disposed in the outer tube; a fixing mechanism disposed in an upper portion of the outer tube; and a linking mechanism disposed in the outer tube and including a rod and a spring member wherein the rod has a top end secured to the fixing mechanism, the rod is partially disposed in the longitudinal grooves, and the rod has a bottom end disposed under a bottom of the lower member, the spring member is put on the rod, and the spring member urges against a bottom of the fixing mechanism and a top of the moving mechanism, wherein the interior of the outer tube has a hexagonal section, the upper member has a hexagonal section, the lower member is cylindrical, and the upper member is larger than the lower member; wherein the fixing mechanism has a hexagonal section, the outer tube further comprises an aperture formed on an upper portion of the outer tube, and the fixing mechanism comprises an upper portion, a lower portion, a transverse hole formed through the upper portion, a transverse hole formed through the lower portion, and two opposite longitudinal troughs formed on an outer surface of the lower portion, the troughs communicating with the transverse hole.

Preferably, the inner tube further comprises an aperture formed on an upper portion, and the lower member further comprises an aperture.

Preferably, the interior has a hexagonal section, the upper member has a hexagonal section, the lower member is cylindrical, and the upper member is larger than the lower member.

Preferably, the fixing mechanism has a hexagonal section, the outer tube further comprises an aperture formed on an upper portion, and the fixing mechanism comprises a transverse hole formed through an upper portion.

Preferably, there is further comprised of a sleeve disposed on a bottom of the outer tube, the sleeve being shaped as funnel having a wide upper portion and a narrow lower portion, and wherein an upper portion of the inner tube inserted into a lower portion of the outer tube is fastened by the sleeve.

Preferably, the fixing mechanism comprises an upper portion, a lower portion, a transverse hole formed through the lower portion, and two opposite longitudinal troughs formed on an outer surface of the lower portion, the troughs communicating with the transverse hole.

Preferably, there is further comprised of a thimble disposed on a top of the outer tube, the thimble including a grommet.

Preferably, each of the moving mechanism and the fixing mechanism are formed of FRP.

In a second aspect of the invention there is provided an umbrella shank comprising an inner tube formed of fibre-reinforced plastic (FRP) and including an interior; an outer tube formed of (FRP) and including an interior having an inner diameter greater than an outer diameter of the inner tube so that the inner tube is configured to insert into the outer tube; a moving mechanism including an upper member and a lower member wherein the upper member has a polygonal section, the upper member is complementary to the interior of the outer tube in shape, the upper member includes a longitudinal groove on an outer surface, the lower member includes a longitudinal groove on an outer surface, the longitudinal grooves, are aligned, the lower member is inserted into the interior of the inner tube, a bottom of the longitudinal groove of the upper member is disposed on a top of the inner tube, the upper member is disposed on the top of the inner tube, and the upper member is disposed in the outer tube; a fixing mechanism disposed in an upper portion of the outer tube; and a linking mechanism disposed in the outer tube and including a rod and a spring member wherein the rod has a top end formed as an inverted U-shaped hook which is secured to the fixing mechanism, the rod is partially disposed in the longitudinal grooves, and the rod has a bottom end formed as a C-shaped hook which is disposed under a bottom of the lower member, the spring member is put on the rod, and the spring member urges against a bottom of the fixing mechanism and a top of the moving mechanism, wherein a hollow, cylindrical buffer member put on the rod proximate the C-shaped hook.

Preferably, there is further comprised a hollow, cylindrical buffer member put on the rod proximate the C-shaped hook.

The invention has the advantage of implementing a light but large umbrella with telescopic shank.

The above and other objects, features and advantages of the invention will become apparent from the following detailed description taken with the accompanying drawings.

DETAILED DESCRIPTION OF THE INVENTION

Figure 1:
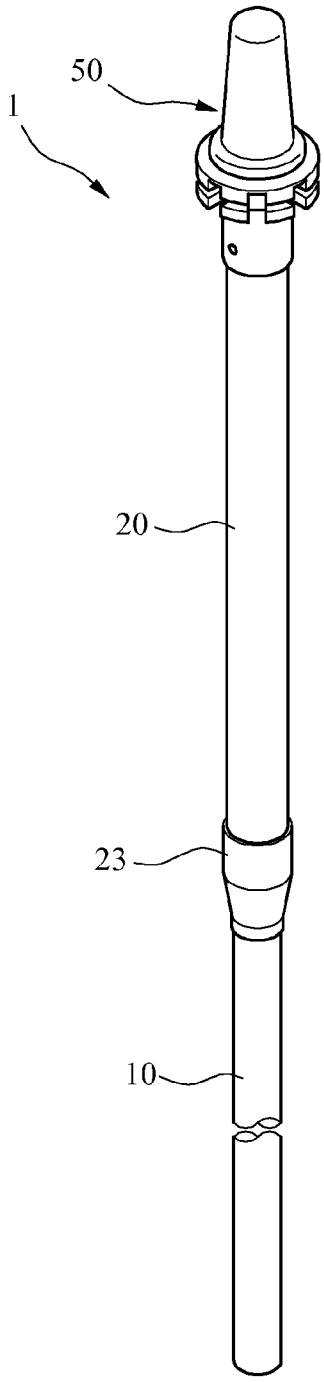
FIG. 1 is a perspective view of a shank and a thimble of a collapsible umbrella according to the invention.
Figure 2:
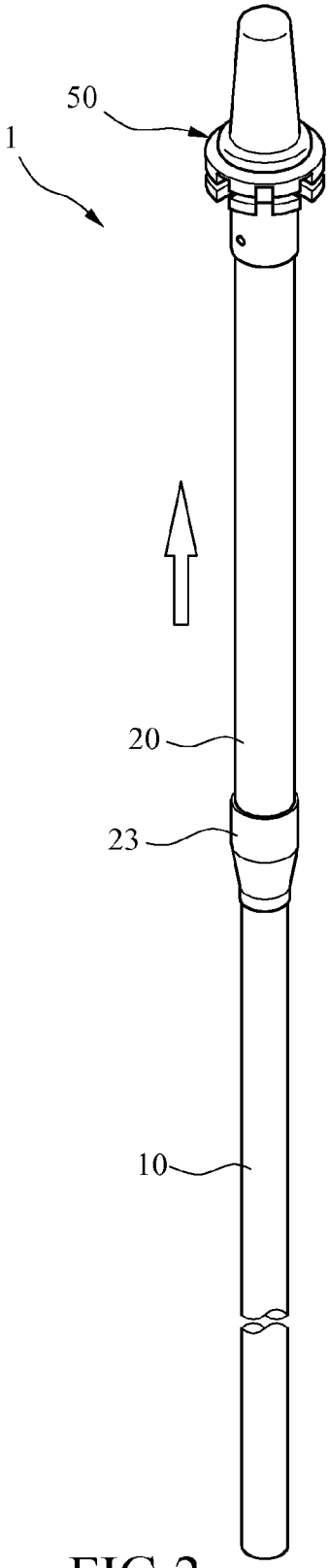
FIG. 2 is a view similar to FIG. 1 showing an extension of the shank.
Figure 3:
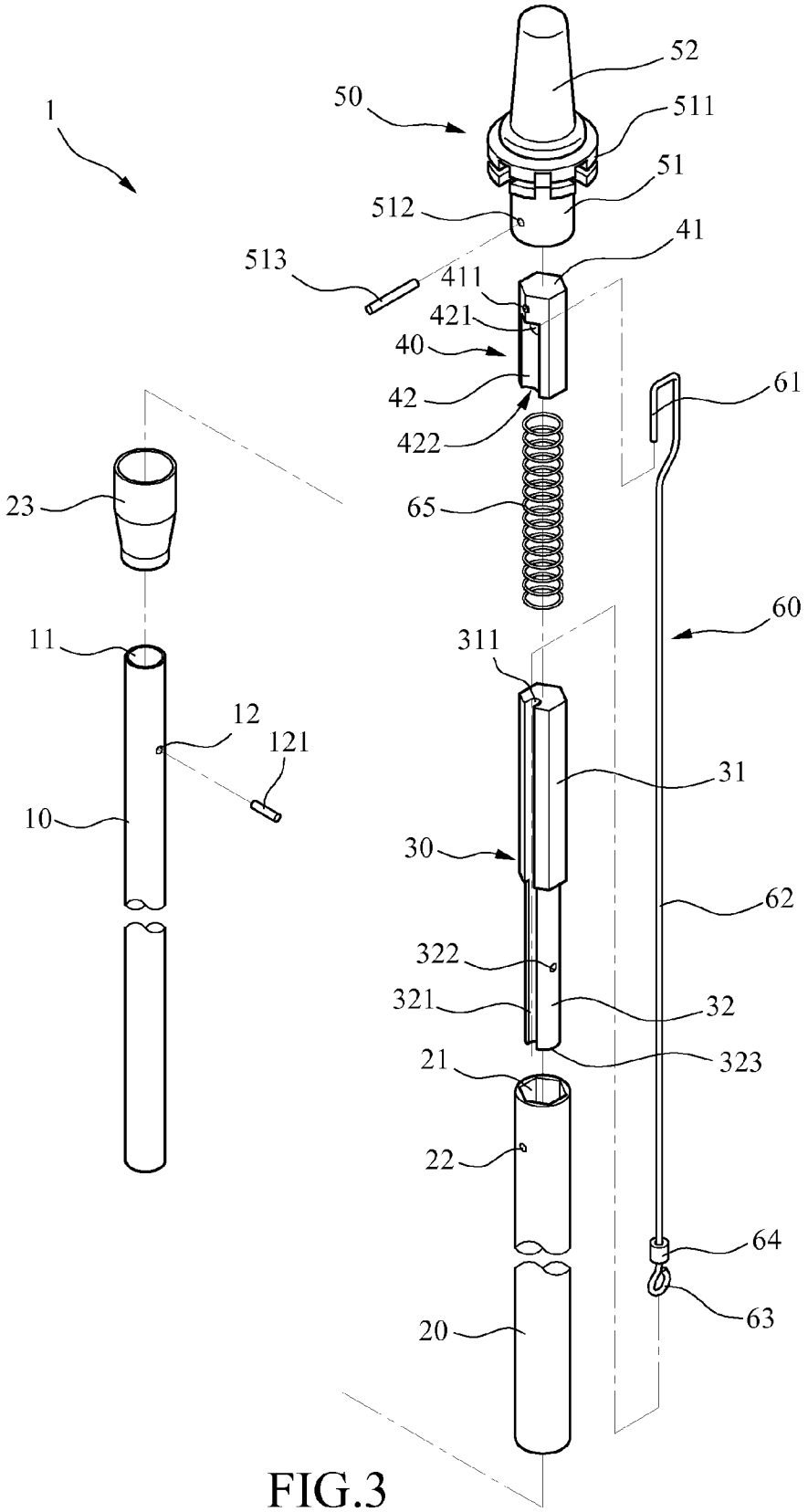
FIG. 3 is an exploded view of the FIG. 1.

Referring to FIGS. 1 to 9, frame of a collapsible FRP umbrella 1 in accordance with the invention is shown. A shank of the frame comprises an inner tube 10, an outer tube 20, a moving mechanism 30, and a linking mechanism 60 as discussed in detail below.

The inner tube 10 has an interior 11 and is made of fibre-reinforced plastic (FRP). An aperture 12 is formed on an upper portion of the inner tube 10 (see FIG. 3). The outer tube 20 has an interior 21 and has a section of polygon, for example, hexagon. It is noted that other sections such as circular are possible in other embodiments. An aperture 22 is formed on an upper portion of the outer tube 20.

An outer diameter of the inner tube 10 is less than an inner diameter of the interior 21 so that the inner tube 10 can be inserted into the outer tube 20. In the embodiment, a sleeve 23 is provided on a bottom of the outer tube 20 and is shaped as funnel (i.e., having a wide upper portion and a narrow lower portion). An upper portion of the inner tube 10 is inserted into a lower portion of the outer tube 20 is fastened by the sleeve 23 (see FIG. 4).

The elongated moving mechanism 30 comprises an upper member 31 and a lower member 32. The upper member 31 is complementary to the interior 21 in shape. For example, the upper member 31 has a hexagonal section. The lower member 32 is cylindrical. The upper member 31 is larger than the lower member 32. The upper member 31 comprises a longitudinal groove 311 on an outer surface, and the lower member 32 comprises a longitudinal groove 321 on an outer surface. The grooves 311, 321 are aligned. An aperture 322 is formed on the lower member 32.

In assembly, the lower member 32 is inserted into the interior 11 of the inner tube 10. A pin 121 is inserted through the aperture 12 into the aperture 322 of the lower member 32 to fasten the lower member 32 of the moving mechanism 30 and the inner tube 10 together. The bottom of the groove 311 is disposed on a top of the inner tube 10. The upper member 31 is disposed on the top of the inner tube 10 and is within the interior 21 of the outer tube 20.

An elongated fixing mechanism 40 is provided in the interior 21 of the outer tube 20. The fixing mechanism 40 is complementary to the interior 21 in shape. For example, the fixing mechanism 40 has a hexagonal section. The fixing mechanism 40 comprises an upper portion 41 and a lower portion 42. A transverse hole 411 is formed through the upper portion 41. A transverse hole 421 is formed through the lower portion 42 adjacent to a joining portion of the upper and lower portions 41, 42, and two opposite longitudinal troughs 422 are formed on an outer surface of the lower portion 42. The troughs 422 communicate with the transverse hole 421 (see FIG. 8).

Figure 4:
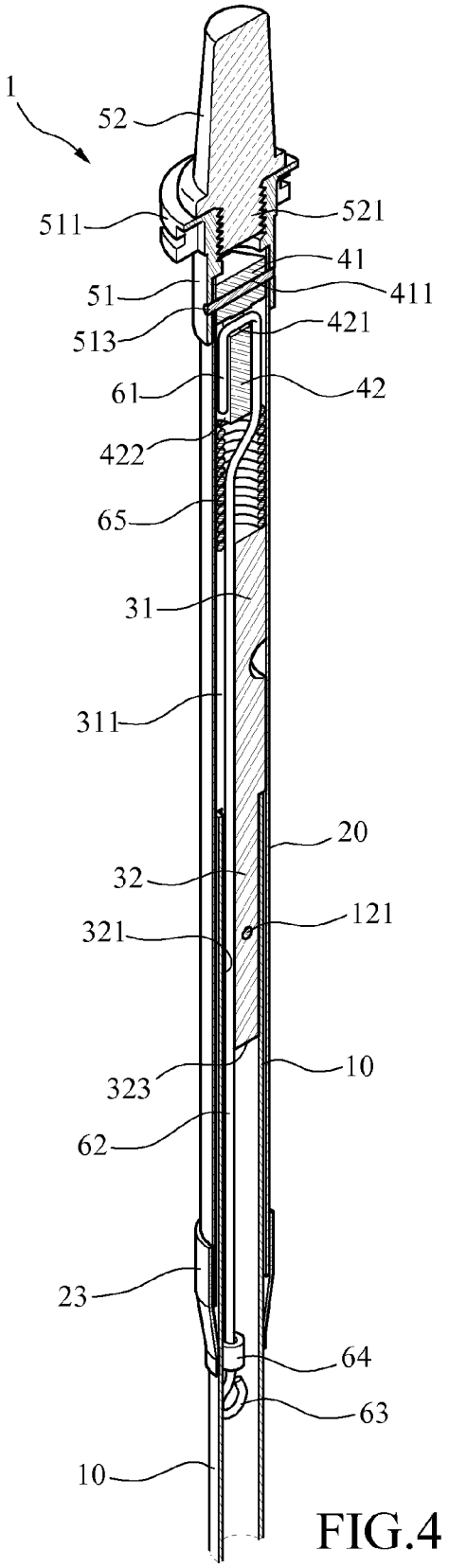
FIG. 4 is a longitudinal sectional view of FIG. 1.
Figure 5:
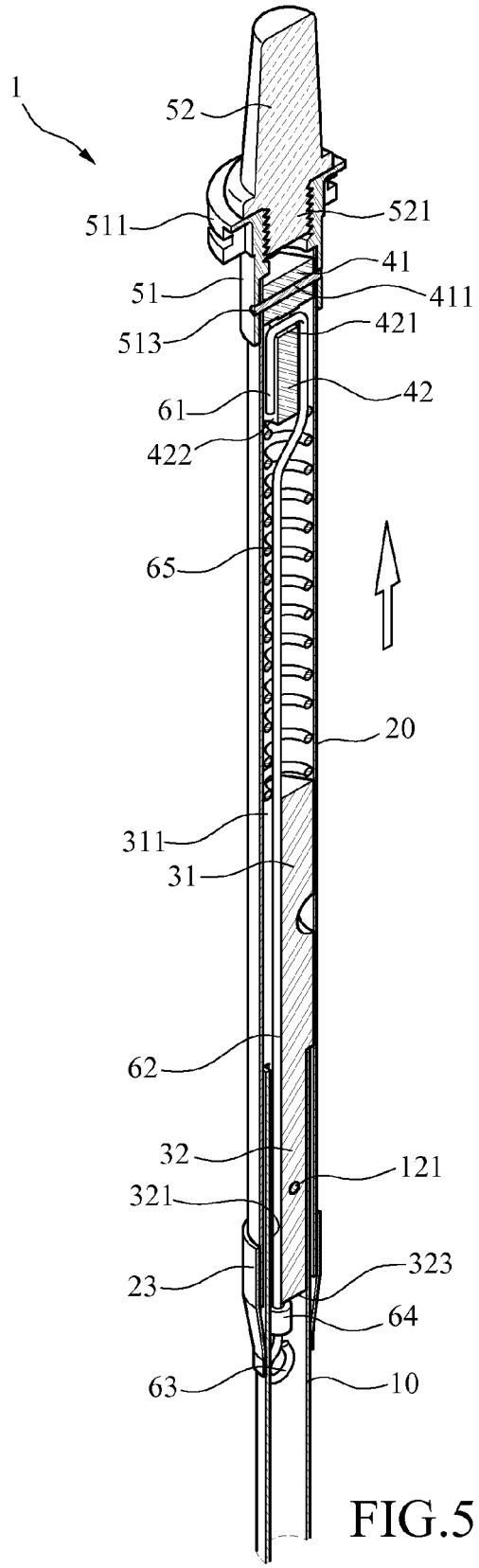
FIG. 5 is a longitudinal sectional view of FIG. 2.

A thimble 50 is provided on a top of the outer tube 20 and comprises a lower pitted cap 51 and an upper extension 52 having an externally threaded lower projection 521 secured to a pitted top of the cap 51 (see FIGS. 4 and 5). A grommet 511 is formed between the cap 51 and extension 52. A transverse hole 512 is formed through the cap 51. In the embodiment, a pin 513 is inserted through the hole 512, the aperture 22, and the hole 411 to fasten the thimble 50, the outer tube 20, and the fixing mechanism 40 together at a top of the umbrellas 1. The outer tube 20, the moving mechanism 30, and the fixing mechanism 40 are formed of FRP.

The linking mechanism 60 comprises an elongated rod 62 and a compression spring 65. The rod 62 is formed of metal or steel and has a top end shaped as an inverted U-shaped hook 61, and a bottom end shaped as a C-shaped hook 63. A hollow, cylindrical buffer member 64 is put on a portion of the rod 62 proximate the hook 63. The hook 61 is inserted through the hole 421 and is engaged with the troughs 422 in order to secure the linking mechanism 60 and the fixing mechanism 40 together (see FIG. 8). The rod 62 is partially engaged with the grooves 311, 321 (see FIGS. 3, 4, 5, and 9). Both a bottom 323 of the lower member 32 of the moving mechanism 30 and a bottom of the groove 321 of the lower member 32 are rested upon the buffer member 64. The spring 65 is put on the rod 62 has a top end urging against a bottom of the lower portion 42 of the fixing mechanism 40 and a bottom end urging against a top of the upper member 31 of the moving mechanism 30. Thus, the moving mechanism 30 is a spring biased member.

Figure 6:
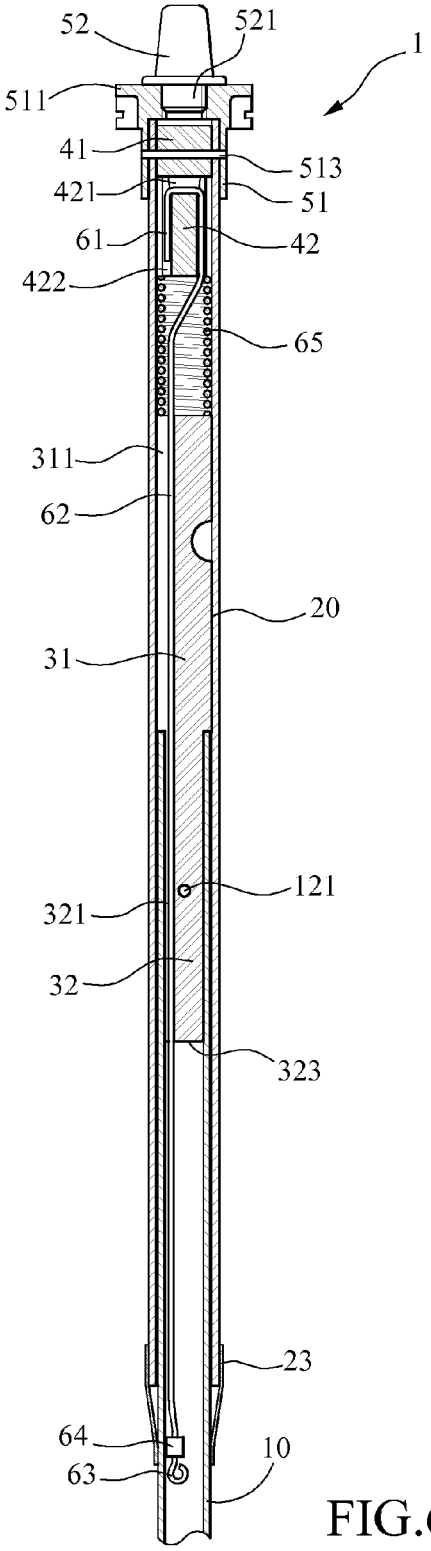
FIG. 6 is a side elevation of FIG. 4.
Figure 7:
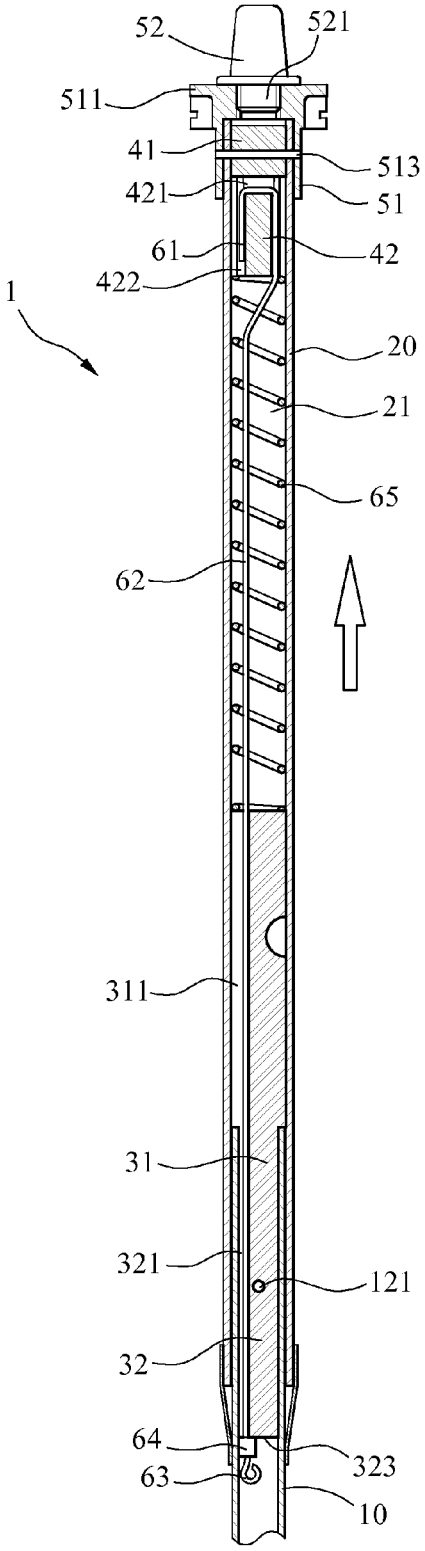
FIG. 7 is a side elevation of FIG. 5.
Figure 8:
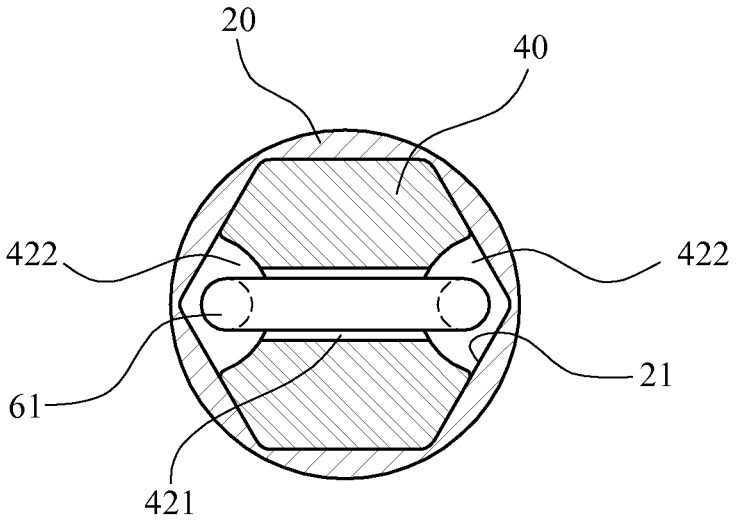
FIG. 8 is a sectional view of the fixing mechanism mounted in the outer tube.

As shown in FIGS. 5 to 7, in an operation of closing the umbrella 1, the inner tube 10 is pushed upward to push the moving mechanism 30 upward together in the outer tube 20. The spring 65 is compressed by the upper member 31 of the moving mechanism 30. Thus, an upper portion of the inner tube 10 is retracted into the outer tube 20 (see FIG. 6).

To the contrary, in an operation of opening the umbrella 1, an individual may hold a handle connected to a lower end of the inner tube 10 and pull down the inner tube 10. As a result, the inner tube 10 extends out of the outer tube 20 with the expansion of the energized spring 65 (see FIG. 2). The opening of the umbrella 1 can be facilitated by installing a runner and a locking device (detailed later) on the inner tube 10 so that the umbrella 1 has an automatic opening mechanism or not.

Figure 9:
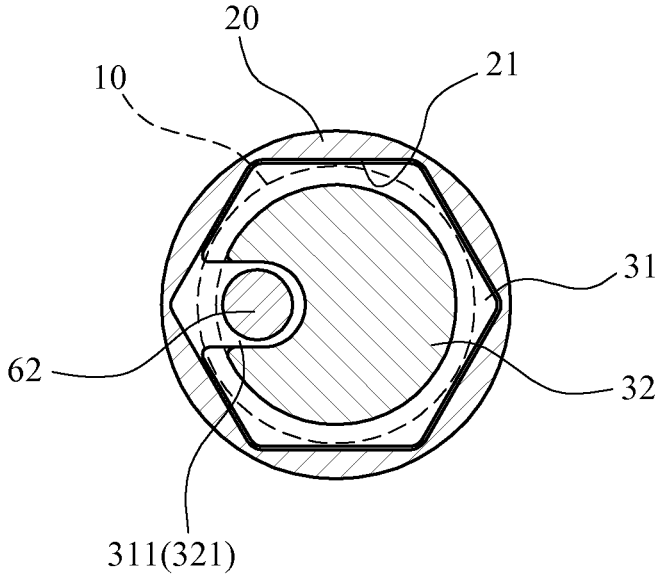
FIG. 9 is a sectional view of the moving mechanism mounted in the outer tube.

As shown in FIG. 9, the complimentary engagement of the upper member 31 of the moving mechanism 30 in the interior 21 of the outer tube 20 ensures a smooth operation of the moving mechanism 30. Further, the inner tube 10 is prevented from rotating in opening or closing operation. Also, the complimentary engagement of the fixing mechanism 40 in the interior 21 of the outer tube 20 ensures a smooth operation of the fixing mechanism 40 by the rod 62. This means that these innovation improvements including generous clearances between complimentary engagement of moving components and other components, for example moving mechanism 30, the fixing mechanism 40 and in the interior 21 of the outer tube 20, without sacrificing reliable operation.

Figure 10:
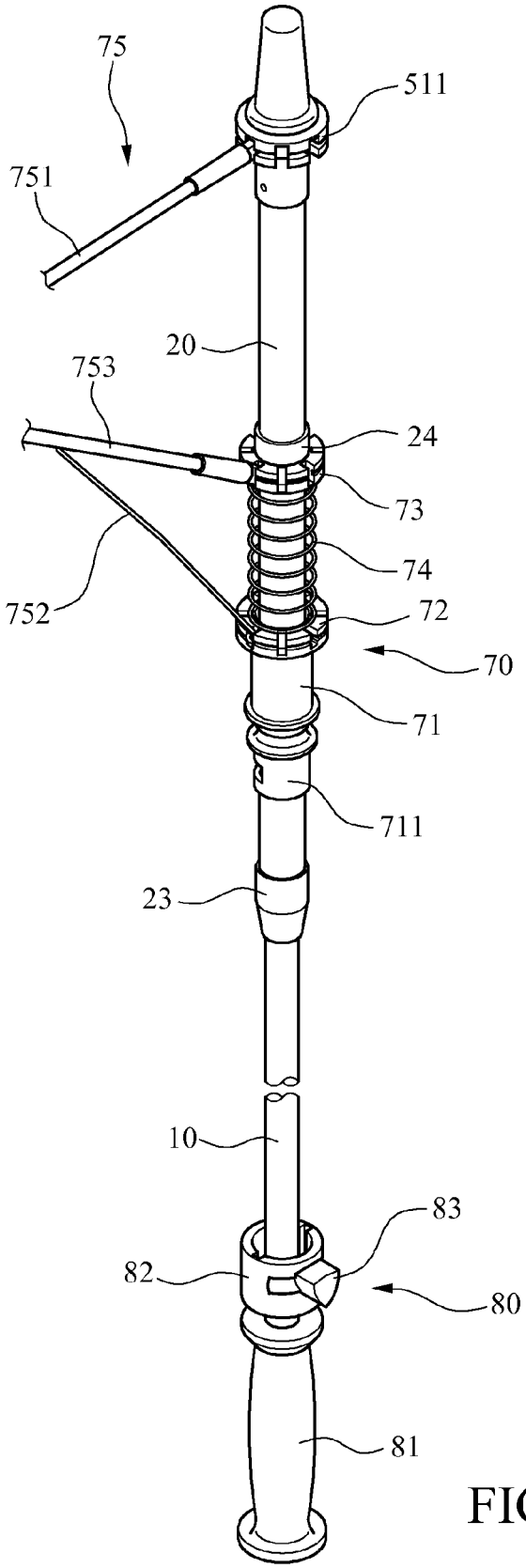
FIG. 10 is a perspective view of an automatically opened umbrella incorporating the invention.
Figure 11:
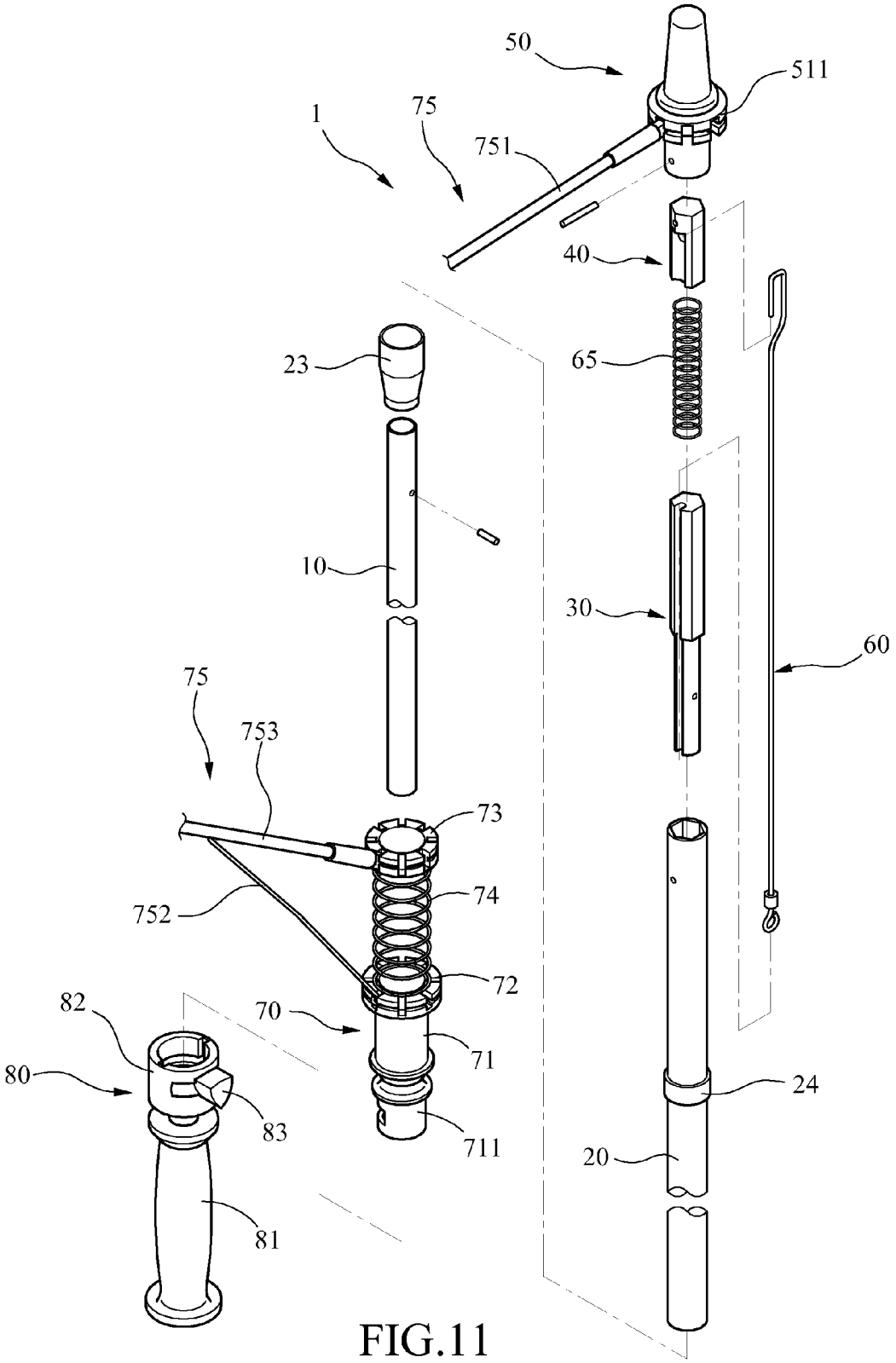
FIG. 11 is an exploded view of FIG. 10.
Figure 12:
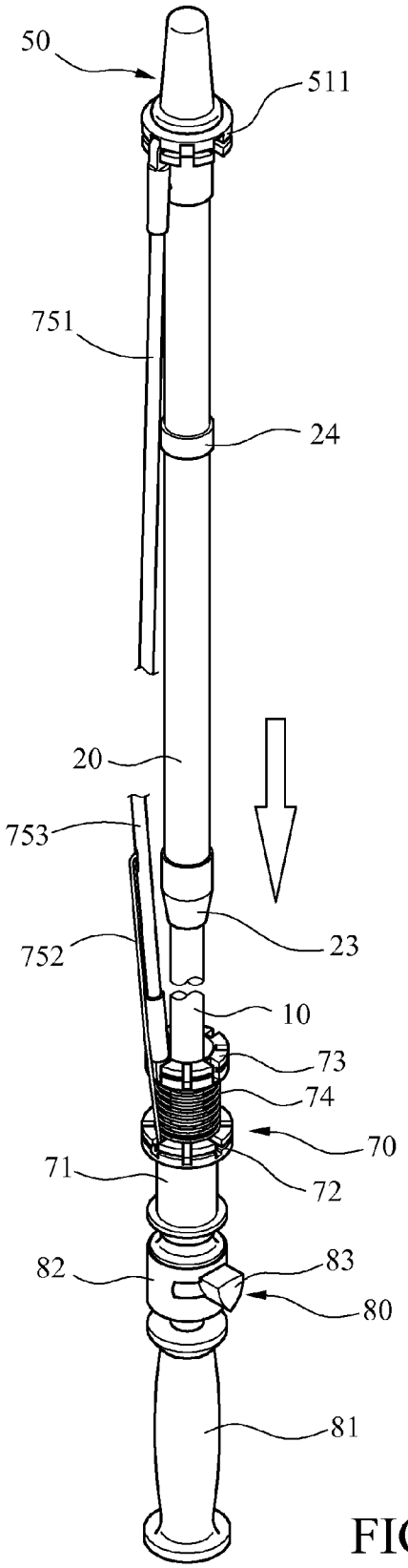
FIG. 12 is a perspective view showing a closing operation of the automatically opened umbrella shown in FIG. 10.
Figure 13:
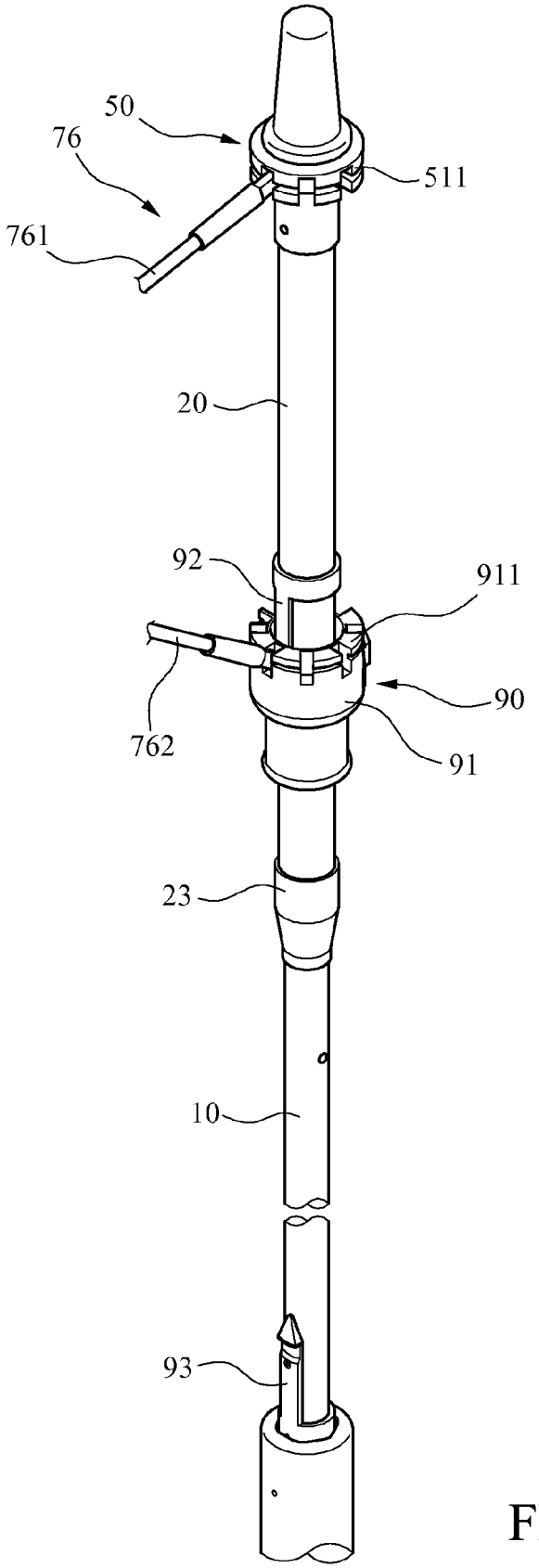
FIG. 13 is a perspective view of a manually opened umbrella incorporating the invention.
Figure 14:
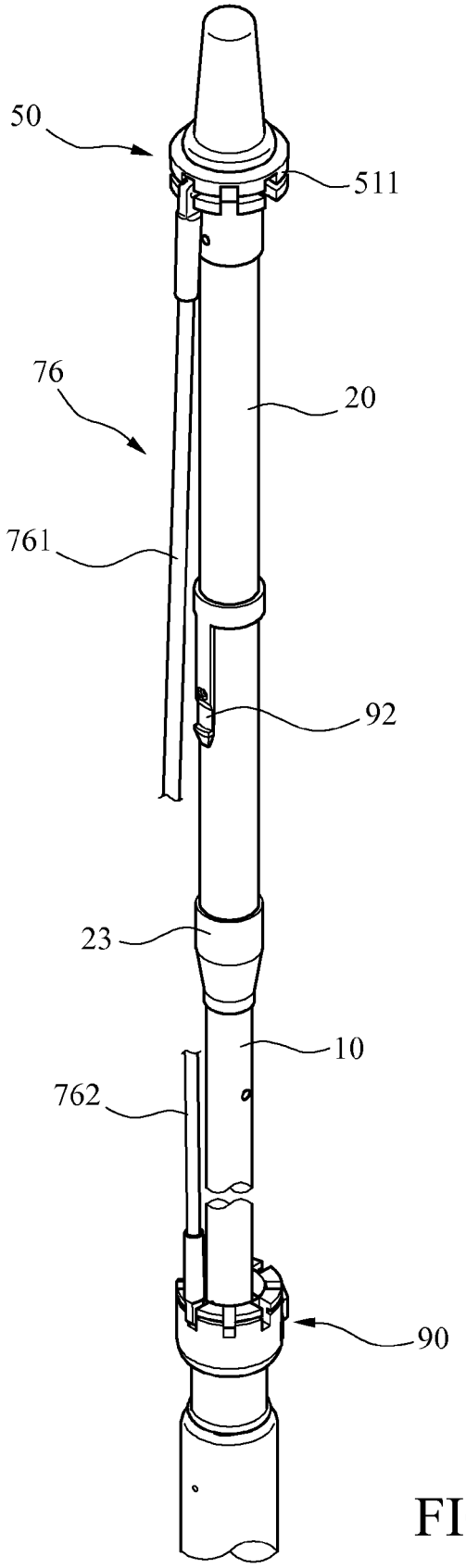
FIG. 14 is a perspective view showing a closing operation of the manually opened umbrella shown in FIG. 13.

Referring to FIGS. 10 to 12 in conjunction with FIGS. 1 to 9, the umbrella 1 is implemented as an automatic (i.e., auto-opening) umbrella as discussed in detail below. A runner 70 is mounted on the outer tube 20 and comprises a sleeve member 71 put on the outer tube 20 and including a lower locking member 711, an intermediate ring 72 provided on a top of the sleeve member 71, a compression spring 74 having a bottom secured to the top of the intermediate ring 72, and an upper ring 73 secured to a top of the compression spring 74. A rib assembly 75 comprises a plurality of ribs 751 with a canopy (not shown) secured thereon, each rib 751 having one end pivotably secured to the grommet 511, a plurality of stretchers 753 each having one end pivotably secured to the upper ring 73, and a plurality of interconnecting members 752 each having one end pivotably secured to the intermediate ring 72 and the other end pivotably secured to an intermediate portion of the stretcher 753. A stop ring 24 is provided on the outer tube 20 between the grommet 511 and the upper ring 73. The stop ring 24 is adapted to stop an upward sliding movement of the upper ring 73.

A locking device 80 is further provided on a lower portion of the inner tube 10 and comprises a lower handle 81, an upper socket 82, and a locking tab 83 disposed on an outer surface of the socket 82.

A downward movement of the runner 70 means an upward movement of the inner tube 10. Thus, the inner tube 10 together with the moving mechanism 30 move upward to cause the upper member 31 to compress the spring 65 (see FIGS. 4 and 6) and also compress the spring 74. Thus, an upper portion of the inner tube 10 is retracted into the outer tube 20, and the locking member 711 is locked by the socket 82. As a result, the inner tube 10 and the outer tube 20 locked together.

A pressing of the locking tab 83 unlocks the locking member 711. Also, the inner tube 10 and the outer tube 20 are unlocked. Both the energized springs 74, 65 expand to push the outer tube 20 upward (see FIG. 10). Also, the runner 70 moves upward along the outer tube 20 until being stopped by the stop ring 24. As a result, the rib assembly 75 is fully extended, i.e., the umbrella 1 being open.

Referring to FIGS. 13 to 15B in conjunction with FIGS. 1 to 9, the umbrella is implemented as a manually open umbrella as discussed in detail below. A runner 90 comprises an upper stop member 92 mounted on the outer tube 20, a sleeve member 91 put on the outer tube 20 and including a ring member 911 below the upper stop member 92, and a lower stop member 93 mounted on the inner tube 10. A rib assembly 76 comprises a plurality of ribs 761 with a canopy (not shown) secured thereon, each rib 761 having one end pivotably secured to the grommet 511, a plurality of stretchers 762 each having one end pivotably secured to the ring member 911 and the other end pivotably secured to an intermediate portion of the rib 761.

Figure 15A:
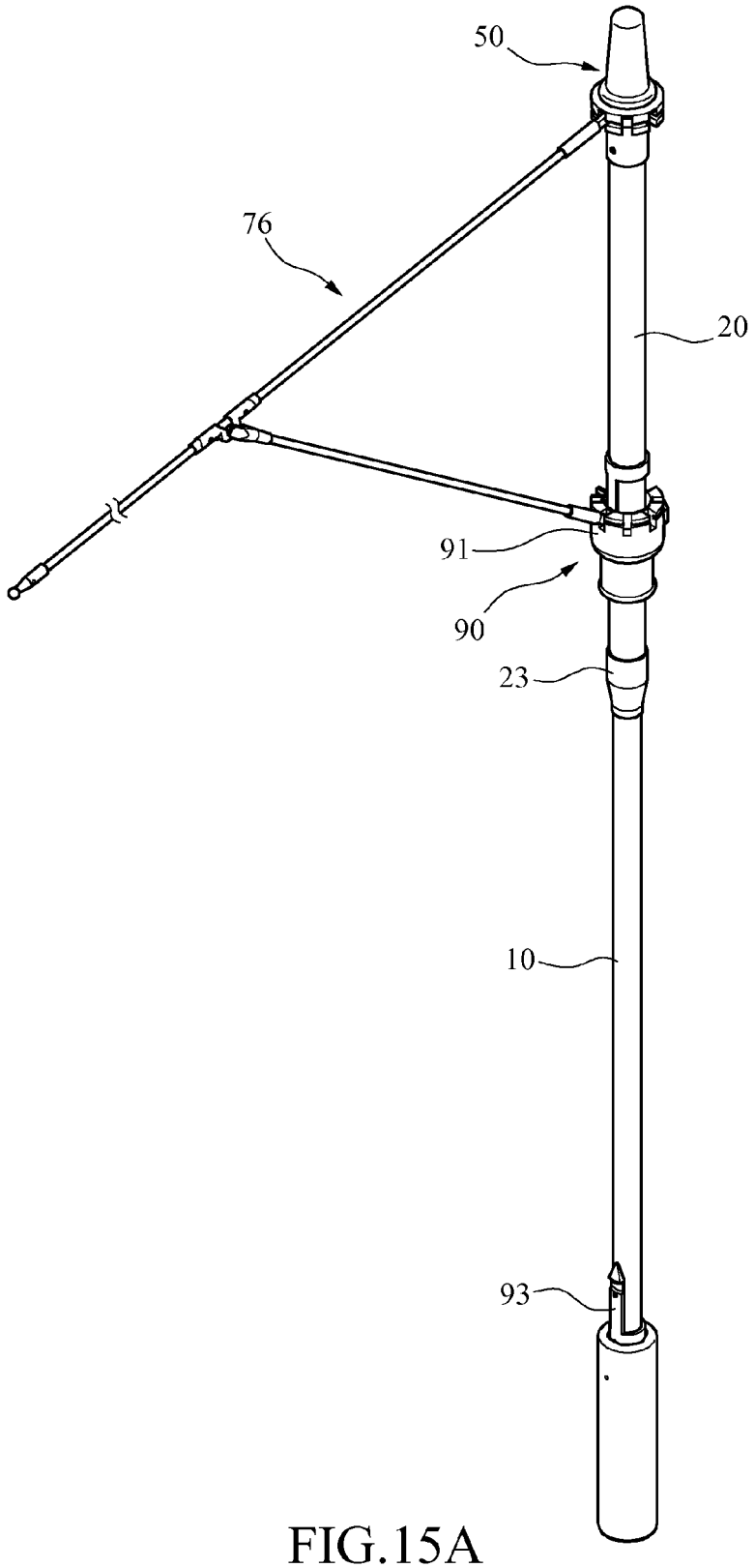
FIG. 15A is a perspective view showing an opening operation of the manually opened umbrella shown in FIG. 13.
Figure 15B:
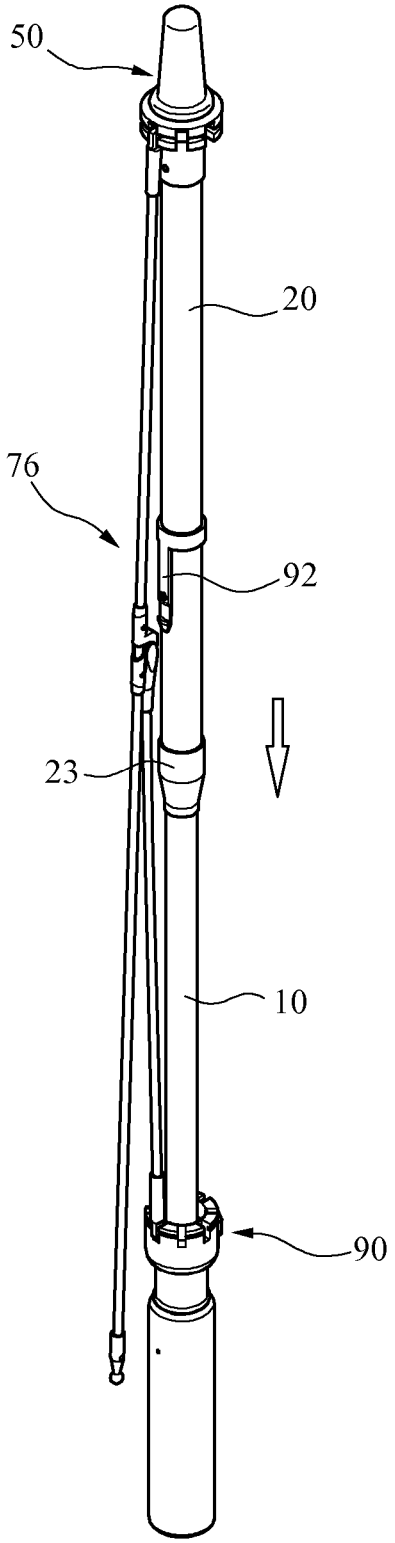
FIG. 15B is another perspective view showing the closing operation of the manually opened umbrella shown in FIG. 13.

An upward movement of the sleeve member 91 will be stopped by the upper stop member 92 in an opening operation of the umbrella (see FIG. 15A). To the contrary, a downward movement of the sleeve member 91 will be stopped by the lower stop member 93 in a closing operation of the umbrella (see FIG. 15B).

While the invention has been described in terms of preferred embodiments, those skilled in the art will recognize that the invention can be practiced with modifications within the spirit and scope of the appended claims.

What is claimed is:

1. An umbrella shank comprising:

an inner tube (10) formed of fibre-reinforced plastic (FRP) and including an interior (11);

an outer tube (20) formed of FRP and including an interior (21) having a polygonal section and an inner diameter greater than an outer diameter of the inner tube (10) so that the inner tube (10) is configured to insert into the outer tube (20);

a moving mechanism (30) including an upper member (31) and a lower member (32) wherein the upper member (31) has a polygonal section, the upper member (31) is complementary to the interior (21) of the outer tube (20) in shape, the upper member (31) includes a longitudinal groove (311) on an outer surface, the lower member (32) includes a longitudinal groove (321) on an outer surface, the longitudinal grooves (311, 321) are aligned, the lower member (32) is inserted into the interior (11) of the inner tube (10), the upper member (31) is disposed on the top of the inner tube (10), a bottom of the longitudinal groove (311) of the upper member (31) is put on a top of the inner tube (10), and the upper member (31) is disposed in the outer tube (20);

a fixing mechanism (40) having a polygonal section disposed in an upper portion of the outer tube (20); and a linking mechanism (60) disposed in the outer tube (20) and including a rod (62) and a spring member (65) wherein the rod (62) has a top end secured to the fixing mechanism (40), the rod (62) is partially disposed in the longitudinal grooves (311, 321), and the rod (62) has a bottom end disposed under a bottom of the lower member (32), the spring member (65) is put on the rod (62), and the spring member (65) urges against a bottom of the fixing mechanism (40) and a top of the moving mechanism (30), wherein the interior (21) of the outer tube (20) has a hexagonal section, the upper member (31) has a hexagonal section, the lower member (32) is cylindrical, and the upper member (31) is larger than the lower member (32); and wherein the fixing mechanism (40) has a hexagonal section, the outer tube (20) further comprises an aperture (22) formed on an upper portion of the outer tube (20), and the fixing mechanism (40) comprises an upper portion (41), a lower portion (42), a transverse hole (411) formed through the upper portion (41), a transverse hole (421) formed through the lower portion (42), and two opposite longitudinal troughs (422) formed on an outer surface of the lower portion (42), the troughs (422) communicating with the transverse hole (421).

2. An umbrella shank comprising:

an inner tube (10) formed of fibre-reinforced plastic (FRP) and including an interior (11);

an outer tube (20) formed of FRP and including an interior (21) having a polygonal section and an inner diameter greater than an outer diameter of the inner tube (10) so that the inner tube (10) is configured to insert into the outer tube (20);

a moving mechanism (30) including an upper member (31) and a lower member (32) wherein the upper member (31) has a polygonal section, the upper member (31) is complementary to the interior (21) of the outer tube (20) in shape, the upper member (31) includes a longitudinal groove (311) on an outer surface, the lower member (32) includes a longitudinal groove (321) on an outer surface, the longitudinal grooves (311, 321) are aligned, the lower member (32) is inserted into the interior (11) of the inner tube (10), the upper member (31) is disposed on the top of the inner tube (10), a bottom of the longitudinal groove (311) of the upper member (31) is put on a top of the inner tube (10), and the upper member (31) is disposed in the outer tube (20);

a fixing mechanism (40) having a polygonal section disposed in an upper portion of the outer tube (20); and a linking mechanism (60) disposed in the outer tube (20) and including a rod (62) and a spring member (65) wherein the rod (62) has a top end formed as an inverted U-shaped hook (61) which is secured to the fixing mechanism (40), the rod (62) is partially disposed in the longitudinal grooves (311, 321), and the rod (62) has a bottom end formed as a C-shaped hook (63) which is disposed under a bottom (323) of the lower member (32), the spring member (65) is put on the rod (62), and the spring member (65) urges against a bottom of the fixing mechanism (40) and a top of the moving mechanism (30), wherein a hollow, cylindrical buffer member (64) put on the rod (62) proximate the C-shaped hook (63).

* * * * *